United States Patent [19]

Collins

[11] 4,196,619

[45] Apr. 8, 1980

[54] GEOLOGICAL ASSESSMENT PROBE

[75] Inventor: Earl R. Collins, La Canada, Calif.

[73] Assignee: The United States of America as represented by the Administrator of the National Aeronautics and Space Administration, Washington, D.C.

[21] Appl. No.: 945,436

[22] Filed: Sep. 25, 1978

[51] Int. Cl.[2] ..... E21B 47/10

[52] U.S. Cl. ..... 73/155

[58] Field of Search ..... 73/155, 151; 166/100, 166/252, 264, 269

[56] References Cited

U.S. PATENT DOCUMENTS

| | | | |
|---|---|---|---|
| 2,564,198 | 8/1951 | Elkins | 73/155 |
| 3,289,474 | 12/1966 | Smith | 73/155 |
| 3,871,218 | 3/1975 | Louis | 73/155 |
| 4,043,192 | 8/1977 | Shuck | 73/155 |

*Primary Examiner*—Jerry W. Myracle

*Attorney, Agent, or Firm*—Monte F. Mott; John R. Manning; Wilfred Grifka

[57] ABSTRACT

A probe is described which can be installed in a side hole that extends from a bore hole in the earth, to assess the permeability of the strata surrounding the borehole. The probe is elongated and has a plurality of seals spaced therealong and sealed to the walls of the side hole to form a plurality of chambers sealed from one another. A tracer fluid injector on the probe can inject a tracer fluid into one of the chambers, while a tracer fluid detector located in another chamber can detect the tracer fluid, to thereby sense the permeability of the strata surrounding the side hole. The probe can include a train of modules, with each module having an inflatable packer which is inflated by the difference between the borehole pressure and the strata pressure.

17 Claims, 8 Drawing Figures

FIG. 4
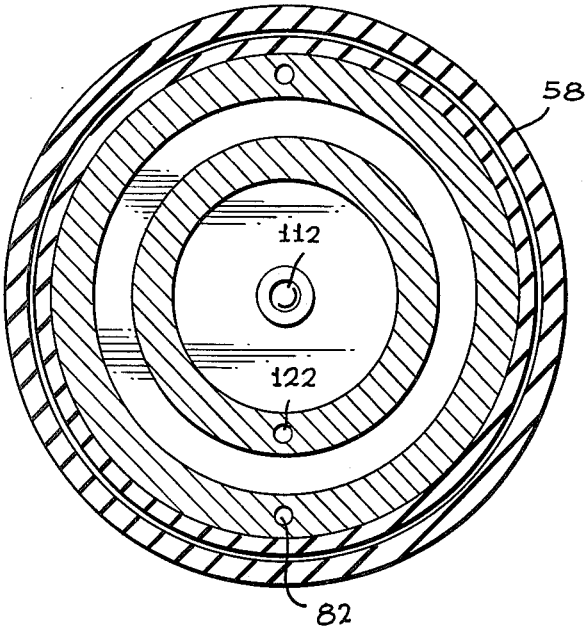
FIG. 6
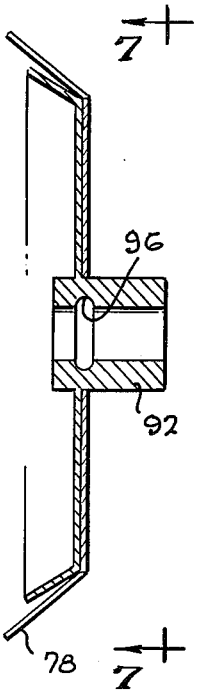
FIG. 5
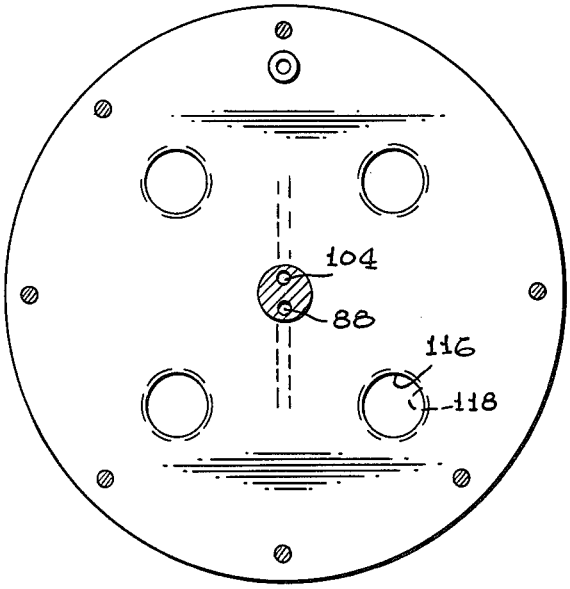
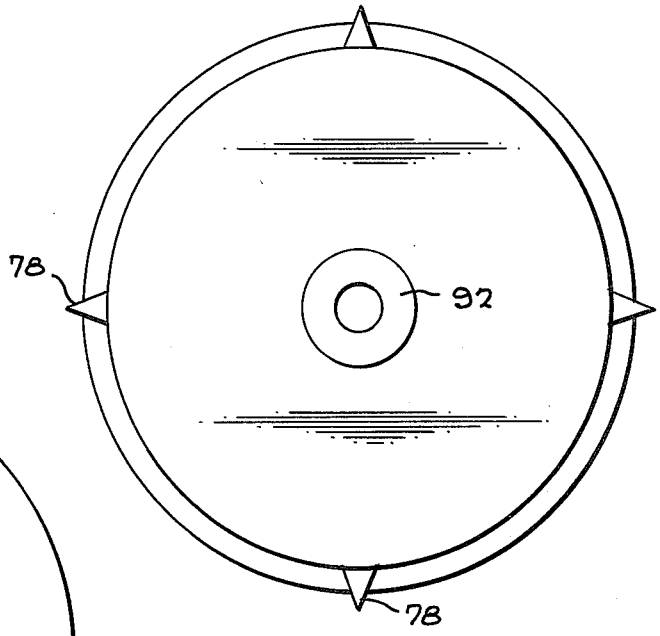
FIG. 7

GEOLOGICAL ASSESSMENT PROBE

ORIGIN OF THE INVENTION

The invention described herein was made in the performance of work under a NASA contract and is subject to the provision of Section 305 of the National Aeronautics and Space Act of 1958, Public Law 85-569 (72 Stat. 435; 42 USC 2457).

BACKGROUND OF THE INVENTION

One method for assessing the potential oil recovery from existing boreholes, involves the drilling of side holes from locations within the borehole, so that a fluid injector can be placed within one side hole and a fluid detector placed within another nearby side hole to measure the flow of a tracer fluid between them through the strata. My earlier patent application Ser. No. 903,240, filed May 5, 1978 on Side Hole Drilling in Boreholes, describes a technique for drilling such side holes. Due to the narrow confines of the bore hole, it is difficult not only to drill the side holes, but also to properly install the probes. An assessment apparatus that minimized the time and equipment required in the borehole, would facilitate the use of side hole probe geologicaL assessment techniques.

SUMMARY OF THE INVENTION

In accordance with one embodiment of the present invention, a probe is provided which can be installed in a side hole extending from a borehole, which minimizes the amount of side hole boring work that must be performed, which enables installation with minimal equipment in the borehole and which enables installation with minimal equipment in the borehole, and which enables important permeability measurements. An elongated probe is utilized having a plurality of expandable seals spaced therealong, to seal the walls of the side hole so as to form a plurality of chambers. A tracer fluid injector is located in one of the chambers while a tracer fluid detector is located in another one of the chambers, to thereby detect the flow rate of the tracer fluid along the strata in a direction toward or away from the borehole.

The probe includes a train of modules connected in series, with most of the modules having an expandable packer for sealing to the walls of the side hole. A group of hoses connect the modules in series to carry pressure from the borehole to each module. A mechanism in each module is operated by the difference in pressure between the borehole pressure and the ambient strata pressure, to inflate the packer of each module firmly against the side hole. The same pressure difference can be utilized to eject the tracer fluid from one of the modules.

The novel features of the invention are set forth with particularity in the appended claims. The invention will be best understood from the following description when read in conjunction with the accompanying drawings.

BRIEF DESCRIPTION OF THE DRAWINGS

FIG. 4 is a view taken on the line 4—4 of FIG. 3.

FIG. 5 is a view taken on the line 5—5 of FIG. 3.

FIG. 6 is a partial sectional view of one of the modules of FIG. 2.

FIG. 7 is a view taken on the line 7—7 of FIG. 6.

DESCRIPTION OF THE PREFERRED EMBODIMENTS

Figure 1:
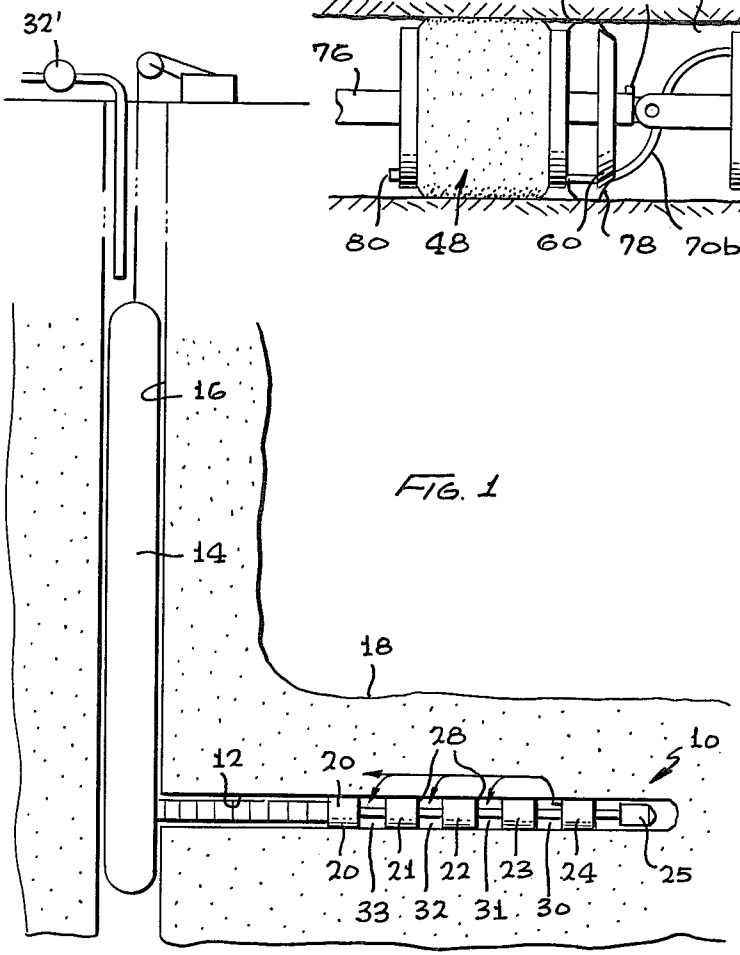
FIG. 1 is a sectional view showing a permeability probe of the present invention, installed deep in the earth.

FIG. 1 illustrates a geological assessment probe 10 of the present invention, which has been installed in a side hole 12 that extends from a boring and implacement apparatus 14 that lies deep within a borehole 16 in the earth. The probe 10 is utilized to measure the permeability of the strata 18 surrounding the borehole 16, which can be useful in calculating the rate of flow of oil from the strata to the borehole for recovery therefrom.

The probe 10 enables measurements of strata permeability by the boring of a single side hole and the implacement of a single probe 10 therein. The probe 10 includes a group of modules 20–25, with most of them carrying a seal 28 that seals against the walls of the side hole 12. One of the modules 24 includes a tracer fluid injector that injects a tracer fluid into a chamber 30 formed between the seals of the modules 23, 24. The injected fluid flows from the sealed chamber 30 into the surrounding strata. A differential pressure is maintained between fluid in the borehole 16 and fluid in the strata 18 at locations spaced from the borehole, as by utilizing a pump 32 that draws out oil or other fluid in the borehole. The tracer fluid therefore tends to move towards the borehole. At times following the injection of tracer fluid into the chamber 30, the tracer fluid can be detected in the chambers 31, 32, and 33 lying on the borehole side of the injection chamber 30. The permeability of the strata can be calculated, based upon knowledge as to the geometry of the side hole and probe, the reduction in borehole pressure, the time of injection and quantity of tracer fluid injection, and the times and/or quantities of tracer fluid detection at the chambers 31–33. Even if the absolute permeability is not readily calculated, the permeability relative to that of other stratas surrounding other boreholes can be determined. It is also possible to cap the borehole 16 and apply positive pressure thereto, so as to create a higher pressure in the borehole than in the surrounding strata, and to detect the tracer fluid in a chamber 34 on the other side of the injection chamber 30. The use of a single side hole and probe therein, enables the measurement of permeability by drilling only a single side hole and installing a single probe, instead of installing two or more probes in different side holes. Furthermore, the permeability is measured in a direction radial to the borehole, which is often the most relevant direction.

Figure 2:
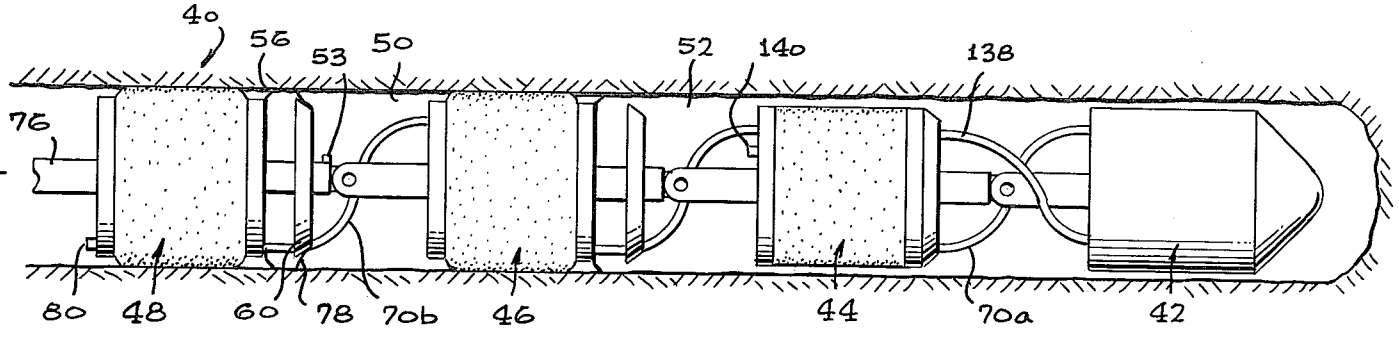
FIG. 2 is a partial side elevation view of a probe of the type shown in FIG. 1.

FIG. 2 illustrates a probe 40 similar to the probe 10 of FIG. 1, but with fewer modules being shown. The probe 40 includes a tracer fluid injection module 42, a pair of primary modules 44, 46, and an anchor module 48. The anchor module 48 seals off the side hole 12 from the main borehole 16, the primary modules 44, 46 partition sections of the side hole to form chambers at 50 and 52, and a tracer fluid injector module 42 is utilized to inject the tracer fluid into one of the chambers. The tracer fluid carried from module 42 through a hose 138 to an ejector outlet 140 opening into chamber 52. A detector 53 located in chamber 50 can detect tracer fluid when it reaches the chamber. For example, radioactive tracer fluid emitting alpha particles can be detected by the detector 53 coupled by wires (not shown) to the apparatus 14 in the borehole and from there to a recorder at ground level.

Figure 3:
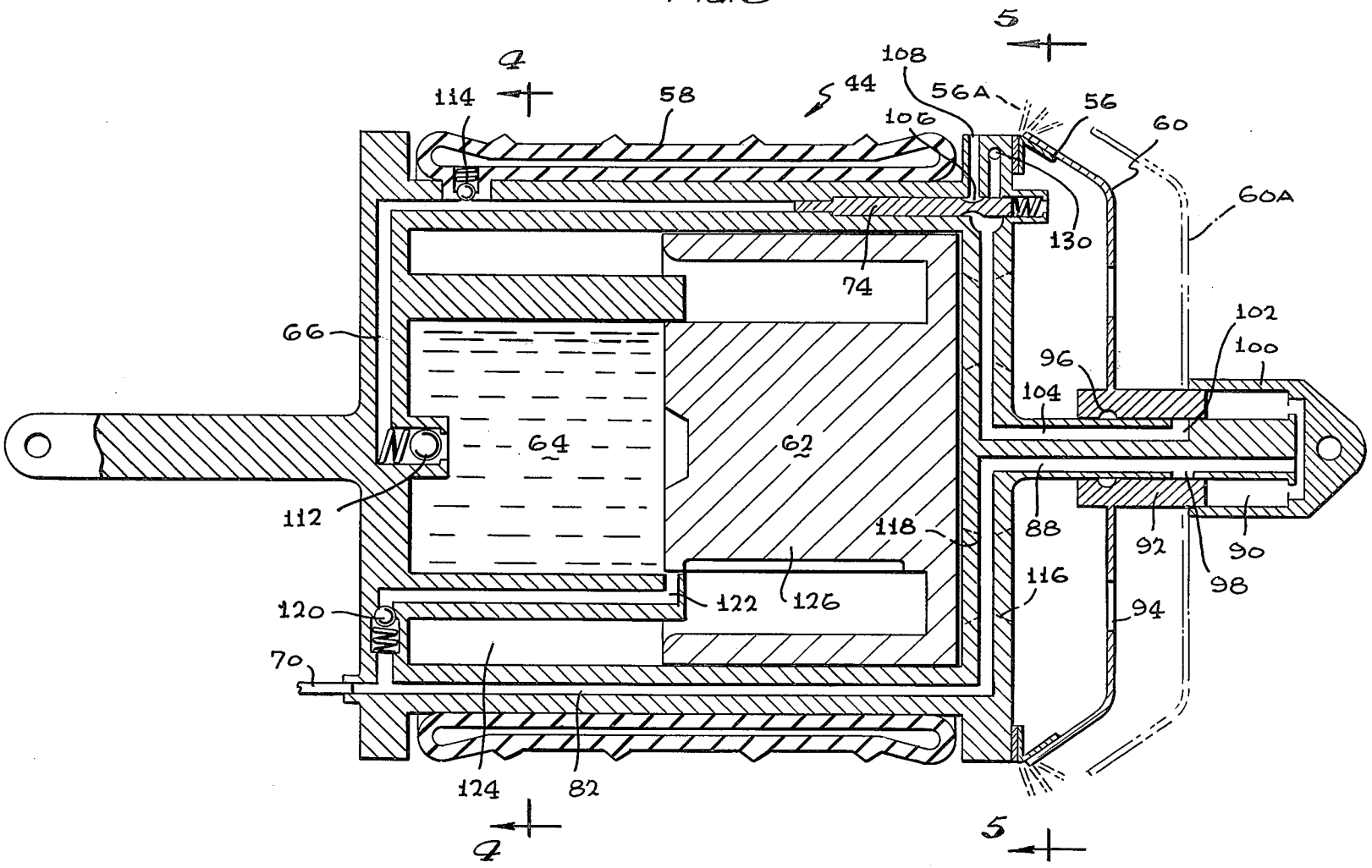
FIG. 3 is a sectional view of one of the modules of the probe of FIG. 2.

FIG. 3 shows one of the primary modules 44 in an undeployed configuration, wherein a group of ring seals 56 has not yet been released to seal against the walls of the side hole, and a packer seal or packer 58 has not yet been inflated to further seal against the side hole and hold the module in place. The module includes several major portions, including a seal retainer 60 which holds the seals in position, but which can be moved forward to the position 60A to release the seals so they spring out to the position 56A against the walls of the side hole to seal thereagainst. The module also includes a power piston 62 that can be moved by the difference between borehole and strata pressure, to move into a fluid container or cylinder 64 which contains a fluid (that can include a liquid and/or air or other gas) to press the fluid through a conduit 66 into the packer 58 to inflate the packer. The modules can be inflated in sequence, with the lower borehole pressure being applied through a tube 70 to one module. After the packer of that module has been inflated the borehole pressure is applied through a next tube 70a to the next module. This is accomplished by use of a shuttle valve 74 that is moved after the packer 58 has been inflated, to connect the pressure from tube 70 to tube 70a.

An understanding of the construction of the modules can be gained by considering the manner in which the train of modules is operated. After the train of modules has been installed in the side hole to the proper distance therein, a link 76 (FIG. 2) on the anchor module is pulled back. The anchor module 48 has a group of barbs 78 attached to the seat retainer 60, so that rearward movement of the anchor module 48 (except for the seal retainer 60 thereof) causes release of the seals 56 so that the side hole is blocked to allow a buildup of pressure in the chamber 50 to ambient strata pressure, while substantially borehole pressure lies behind the anchor module. The deployment of the seals 56 of the anchor module, therefore produces a differential pressure, which is utilized to automatically inflate the packer 58 of the anchor module, and to subsequently deploy the seals and inflate the packers of the other modules of the train. The borehole pressure which lies in the portion of the side hole behind the anchor modules 48, can be carried from an inlet 80 of the anchor module, through a hose 70b to the next module 46, and through subsequent hoses to the following modules.

Referring to FIG. 3, the low borehole pressure is received through the tube 70 of module 44 and flows through conduits 82 and 88 to a cylinder 90, to draw forward on a piston 92 attached to the seal retainer 60. The side of the piston opposite chamber 90 is exposed to the higher strata pressure through holes 94 in the seal retainer. When the piston 92 moves forward into the chamber 90, the seal retainer 60 moves forward to the position 60A, to release the seals 56 for sealing against the walls of the side hole.

The forward movement of the piston 92 aligns a groove 96 in the piston with an opening 98 in the frame 100 of the module, so that the low pressure can be carried through the groove 96 to another opening 102 in the frame that leads to a conduit 104. The lower pressure in the conduit 104 is transmitted through a groove 106 in the shuttle valve 74 to a low pressure bleed port 108 to lower the pressure behind the deployed seals at 56A. This aids in sealing the seals against the walls of the side hole.

As mentioned above, the packer 58 is inflated by reason of the power piston 62 forcing fluid in cylinder 64 through a pair of check valves 112, 114 into the packer. The power piston 62 can initially begin moving by reason of the higher strata pressure in front of the module, which is carried through openings 116, 118 in the module frame to bear against the forward end of the piston. The force on the piston 62 is increased by applying the low borehole pressure through the tube 70 and through a check valve 120 and port 122 to an auxiliary chamber 124 lying around the piston portion 126 that actually presses against the fluid in the cylinder 64. The pressure differential between fluid in front of the piston and fluid in the chamber 124 aids in moving the piston 62, to produce a more rapid and fuller expansion of the packer 58. Thus, by providing a larger piston area on the high pressure side facing strata pressure, than on the pumping side facing cylinder 64, the pressure difference is multiplied to provide a final pressure in packer 58 which exceeds strata pressure.

When the power piston 62 has fully inflated the packer 58 into firm contact with the walls of the side hole, the pressure applied by the piston along conduit 66 presses forward on the shuttle valve 74, to align the groove 106 therein with a duct 130 that leads to a next hose 70a. The low borehole pressure applied through tube 70 to the module 44, and which has been applied through conduits 82, 88 and through piston 92 to the conduit 104 can then be applied through the duct 130 to the tube 70a leading to the control port inlet of the next module in the train of modules. The forward movement of the shuttle valve 74, also ceases the delivery of the low pressure through the bleed port 108. Thus, the difference between borehole pressure and strata pressure, is utilized to release the seals 56, to provide an assist to the power piston 62 to inflate the packer 58, and to then move the shuttle valve 74 to apply the borehole pressure to the next module to operate it. The modules 46, 48 behind module 44 are similar to module 44 (except that anchor module 48 has barbs 78).

Figure 8:
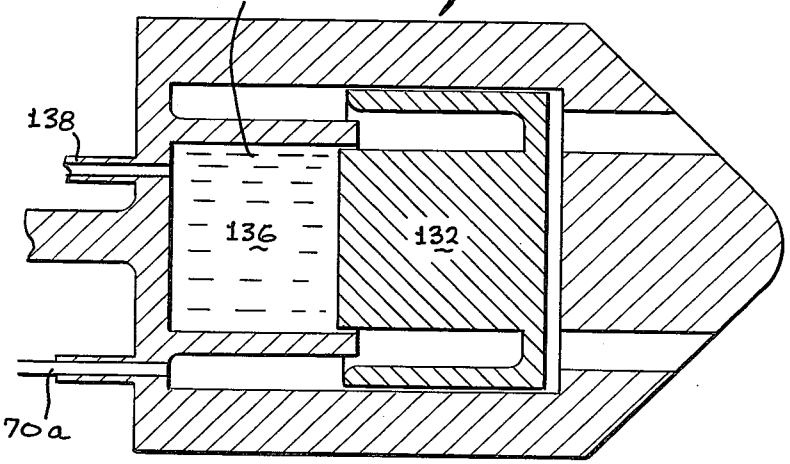
FIG. 8 is a partial sectional view of one of the modules of FIG. 2.

The module 42 at the front end of the train is a simplified version of the other modules. As shown in FIG. 8, the leading module 42 does not utilize seals or a packer, but comprises primarily a piston 132 similar to the pistons 62 of the module of FIG. 3, and with piston 132 being utilized to eject a tracer fluid 134 lying in a cylinder 136. Instead of ejecting the tracer fluid directly into the region behind the module 42, the tracer fluid is carried through a hose 138 that leads through the preceding module 44 (FIG. 2) to an outlet 140 opening into the chamber 52. The tracer fluid hose 138 is utilized because the area behind the leading module 42 is not as closely confined in dimensions since the leading module does not have an inflatable packer to seal it to the side hole walls. Similarly, the sensor 53 is located in a chamber 50 of limited length. The outlet 140 for tracer fluid lies on one side of the seals, formed by the ring seal and packer seal of module 46, so that the tracer fluid is ejected a distance from the sensor 53 located on the other side of the seals. In order to assure that tracer fluid is not injected prematurely, before the seals and packer of the previous module 44 have been deployed, the shuttle valve 74 of FIG. 3 can be coupled to a control valve that prevents the passage of tracer fluid to the outlet until the shuttle valve 74 has been moved forward.

Thus, the invention provides a relatively easily installed probe arrangement for installation in a side hole extending from a borehole, to provide especially useful measurements of the permeability of the strata surrounding the borehole. This is accomplished by the use of a probe having a plurality of sealing means, such as simple ring seals and inflatable packer type seals, to divide the side hole into a plurality of separate chambers. Ring seals can be utilized to enhance sealing, while packer seals can be useful in sealing off a substantial length of the side hole to provide considerable spacing between the nearest chambers such as 50 and 52. Fluid injected into one of the chambers can be detected another one of the chambers, to provide an indication of the flow rate and therefore permeability of the strata. The power required to deploy the ring and packer seals, as well as to eject the tracer fluid, can be derived by establishing a reduced (or increased) pressure in the borehole, as compared to the pressure in the surrounding strata, which is useful also in creating a somewhat faster flow of fluid through the strata for easier measurement. The borehole pressure can be transmitted to a train of module through a series of hoses connecting them together, and the seals of the modules can be deployed sequentially to more firmly deploy each of the seals. The use of a single side hole divided into chambers sealed from one another, avoids the need to form two separate side holes and the need to install separate fluid ejector and sensor devices in the different holes. The fact that the ejector and sensor are located along a line extending radially from the main borehole, means that permeability is measured in a direction most relevant to estimating the flow of oil into the borehole, the effectiveness of fluid injection into the strata from the borehole, or any operation originating from the borehole.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A geological assessment apparatus useful for deployment in a side hole extending from a borehole into the strata surrounding the borehole, for enabling an assessment of the strat, comprising:

an elongated probe having at least one expandable seal positioned therealong to seal to the walls of a side hole in a substantially 360° seal that resists the free flow of fluid along the length of the hole, a fluid ejector having an outlet located on one side of said seal, and a fluid detector located on another side of said seal opposite said ejector, whereby to enable the measurement of a controlled fluid flow through the strata.

2. A geological assessment installation assessing a strata surrounding a borehole in the earth, comprising, an elongated side hole extending substantially radially from a location along the borehole;

a probe lying in said side hole and having a plurality of seals sealed against the walls of the side hole to form a plurality of chambers spaced along the length of the side hole;

ejector means lying in one of said chambers, for ejecting a fluid therein; and a fluid detector located in another of said chambers.

3. The installation described in claim 2 including:

pump means coupled to said borehole, creating a differential pressure along said side hole.

4. Geological assessment apparatus useful for deployment in a side hole extending from a borehole into the strata surrounding the borehole comprising:

a plurality of modules connected in series, for deployment in the side hole; and means for detecting fluid flow in a region of said side hole;

each module having an inflatable packer seal, a cylinder containing a fluid which can expand the seal and which is coupled to the seal, a piston movable into the cylinder, means for applying ambient strata pressure to one end of the piston opposite the cylinder, and means for applying borehole pressure to another end of the piston, whereby to utilize the difference between side hole and borehole pressure to pressurize the seal.

5. Geological assessment apparatus useful for deployment in a side hole extending from a borehole into the strata surrounding the borehole assessment of the strata, comprising:

a train of modules connected in series, including an outermost module, each module including an expandable packer for sealing to the walls of a hole, and at least one module having means for detecting fluid flow; and a plurality of hoses connecting said modules in series, for coupling a pressure in said conduit sequentially to said modules;

each module including means responsive to the pressure in a hose leading thereto from a previous module for expanding the packer, and for thereafter coupling the hose leading thereto from a previous module to another hose leading to the next module of the train, whereby to expand the packers of said modules in sequence.

6. Geological assessment apparatus useful for deployment in a side hole extending from a borehole into the strata surrounding the borehole, comprising:

a plurality of modules connected in series, and including means for detecting fluid flow;

a first of said modules including a piston having first and second piston portions, a cylinder including a first cylinder portion containing a seal-inflating fluid and positioned to closely receive said first piston portion and a second cylinder portion positioned to closely receive said second piston portion, means for applying the pressure of fluid in the side hole to said piston to urge said piston first cylinder portion to said inflatable seal to utilize fluid therein to inflate the seal, and a conduit coupling fluid in the borehole to said second cylinder portion, whereby to utilize the difference between side hole and borehole pressure to aid in pressurizing the seal.

7. A geological assessment apparatus for deployment in a hole in the earth comprising:

means for detecting fluid flow;

a frame;

a seal mounted on said frame and resiliently outwardly biased;

a seal retainer movably mounted on said frame between a first position around said seal and a second position away from said seal; and barb means mounted on said retainer to resist movement of the retainer in a first direction, whereby movement of the frame in said first direction enables deployment of the seal.

8. A method for assessing a strata surrounding a borehole, comprising:

forming a side hole extending from the borehole;

sealingly separating said side hole into a plurality of chambers spaced along the length of the side hole;

ejecting a tracer fluid into one of the chambers; and detecting the tracer fluid in another of said chambers.

9. The method described in claim 8 including:

applying a pump means to said borehole to generate a difference between pressure in the borehole and at strata locations spaced from the borehole.

10. The method described in claim 8 wherein:

said step of sealingly separating said side hole into a plurality of chambers includes coupling a fluid filled cylinder to an expandable seal that can expand against the walls of the side hole, and applying strata pressure at a location spaced from the borehole and the pressure at the borehole to different ends of a piston, to press the piston into the cylinder.

11. In a geological assessment apparatus useful for deployment in a side hole extending from a borehole into the strata surrounding the borehole, which includes apparatus for detecting fluid flow into a region of the side hole which is sealed from another region, the improvement comprising:

an elongated probe having a plurality of deployable seals spaced therealong, said probe having a plurality of mechanisms each having a pair of pressure inputs and activatable by the difference in pressure at said inputs to deploy one of said seals, and means for applying strata pressure to one of said inputs and borehole pressure to the other input.

12. The apparatus described in claim 11 wherein:

each of said seals comprises a seal biased to move outwardly against a side wall; and each of said mechanisms includes a retainer holding said seal against outward movement, a cylinder, and a piston movable in said cylinder and coupled to said retainer to move said retainer out of engagement with said seal.

13. The apparatus described in claim 11 wherein:

each of said seals is inflatable; and each of said mechanisms includes a cylinder holding a fluid for inflating said seal and coupled to said seal, and a piston movable by said pressure difference into said cylinder to drive out the fluid therein.

14. A geological assessment apparatus useful for deployment in a side hole extending from a borehole into the strata surrounding the borehole, for enabling an assessment of the strata, comprising:

an elongated probe having a plurality of expandable seals spaced along the length of the probe to form a plurality of sealed-off chambers of limited length spaced along a side hole, a fluid ejector having an outlet located in one of the chambers, and a fluid detector located in another of said chambers, whereby to control the area from which fluid passes into the strata and from which fluid for detection is received.

15. A geological assessment apparatus useful for deployment in a hole extending into a strata, for enabling an assessment of the strata, comprising:

an elongated probe having at least one fluid inflatable expandable seal positioned therealong to seal to the walls of a hole, a fluid ejector having an outlet located on one side of said seal, and a fluid detector located on another side of said seal opposite said ejector;

said probe including a pressurizing mechanism comprising walls forming a fluid container, means responsive to the difference in fluid pressure in said strata and in a portion of said hole for collapsing the volume of said container, and means coupling the inside of said container to said expandable seal to inflate it.

16. The apparatus described in claim 15 including:

pump means coupled to said borehole to reduce the pressure therein, whereby to provide a considerable pressure difference to help inflate the inflatable seal.

17. A geological assessment apparatus useful for deployment in a hole extending into a strata, for enabling an assessment of the strata, comprising:

an elongated probe having at least one expandable seal positioned therealong to seal to the walls of a hole, a tracer fluid ejector having an outlet located on one side of said seal, and a tracer fluid detector located on another side of said seal opposite said ejector, whereby to enable the measurement of a controlled fluid flow through the strata;

said tracer fluid ejector including a pressurizing mechanism comprising walls forming a container containing said tracer fluid, means responsive to the difference in fluid pressure in said strata and in a portion of said hole for collapsing the volume of said container, and means coupling the inside of said container to said fluid injector outlet.

* * * * *